US007938300B2

(12) United States Patent
Diamond et al.

(10) Patent No.: US 7,938,300 B2
(45) Date of Patent: May 10, 2011

(54) NESTABLE HANGER WITH INTEGRATED CASCADE HOOK

(75) Inventors: Aaron Diamond, Hollis Hills, NY (US); Robert Doherty, Northport, NY (US)

(73) Assignee: Worldwide Home Products, Inc., Ronkonkoma, NY (US)

( * ) Notice: Subject to any disclaimer, the term of this patent is extended or adjusted under 35 U.S.C. 154(b) by 0 days.

(21) Appl. No.: 12/182,351

(22) Filed: Jul. 30, 2008

(65) Prior Publication Data

US 2010/0025439 A1 Feb. 4, 2010

(51) Int. Cl.
*A41D 27/22* (2006.01)

(52) U.S. Cl. ..... 223/85; 223/88

(58) Field of Classification Search ..... 223/85, 223/88, 92, 95; D6/315, 317, 318, 319
See application file for complete search history.

(56) References Cited

U.S. PATENT DOCUMENTS

| | | | | | |
|---|---|---|---|---|---|
| 1,580,839 | A | | 4/1926 | McKenna | |
| 2,658,627 | A | | 11/1953 | Magnuson | |
| 3,148,809 | A | * | 9/1964 | Tufts | 223/87 |
| D276,967 | S | * | 1/1985 | Arnold et al. | D6/327 |
| 4,653,678 | A | | 3/1987 | Blanchard | |
| 4,714,183 | A | | 12/1987 | Tontarelli | |
| D295,579 | S | * | 5/1988 | Arnold | D6/317 |
| 4,871,098 | A | | 10/1989 | Bredeweg | |
| 5,029,739 | A | | 7/1991 | Blanchard | |
| 5,074,445 | A | | 12/1991 | Chen | |
| 5,074,446 | A | | 12/1991 | Suddath | |
| 5,584,455 | A | | 12/1996 | Artemi | |
| 5,613,628 | A | | 3/1997 | Burkhalter | |
| 5,645,200 | A | | 7/1997 | McDowell | |
| 5,803,321 | A | | 9/1998 | Willinger | |
| D419,310 | S | * | 1/2000 | Abdi | D6/317 |
| 6,036,064 | A | | 3/2000 | Tawil | |
| 6,070,772 | A | | 6/2000 | Bond | |
| 6,105,834 | A | | 8/2000 | Cohen | |
| 6,308,872 | B1 | | 10/2001 | Duerr | |
| 6,457,615 | B1 | * | 10/2002 | Lam | 223/89 |
| 6,467,658 | B1 | | 10/2002 | Olk | |
| 6,497,347 | B1 | | 12/2002 | Feibelman | |
| 6,688,503 | B2 | * | 2/2004 | Viazanko et al. | 223/89 |
| 2003/0132258 | A1 | * | 7/2003 | Viazanko et al. | 223/85 |
| 2008/0197160 | A1 | * | 8/2008 | Lee | 223/85 |
| 2008/0257919 | A1 | * | 10/2008 | Yamada | 223/85 |

OTHER PUBLICATIONS

Merrick Engineering Products, http://www.merrickengineering.com/product.html, Aug. 10, 2006.*

* cited by examiner

*Primary Examiner* — Gary L. Welch
*Assistant Examiner* — Nathan E Durham
(74) *Attorney, Agent, or Firm* — Jeffrey Sonnabend; SonnabendLaw

(57) ABSTRACT

A hanger is disclosed having a hanger supporting means in the form of a cascade hook for supporting additional hangers therefrom, wherein the cascade hook may be inserted through a rear aperture of a like hanger to facilitate the nesting of one hanger with the other like hanger.

24 Claims, 5 Drawing Sheets

NESTABLE HANGER WITH INTEGRATED CASCADE HOOK

BACKGROUND OF THE INVENTION

1. Field of the Invention

The present invention pertains to the field of clothing hangers and in particular to the field of nestable hangers having hanger supporting means for supporting additional hangers therefrom.

2. Background of the Related Art

Hangers having nestable configurations are disclosed in the prior art, as are hangers having hanger supporting means for supporting additional hangers therefrom.

One example of a hanger having hanger supporting means for supporting additional hangers therefrom may be found, for instance, in U.S. Pat. No. 4,653,678 to Blanchard et al., which discloses a "ganging hook" via which additional hangers may be supported. The "ganging hook" disclosed in Blanchard et al. extends downwardly from the hanger body. The "ganging hook" of Blanchard et al. does not provide any nesting functionality to the hanger.

Another example of a hanger having supporting means for supporting additional hangers therefrom is U.S. Pat. No. 4,871,098 to Bredeweg et al. The hanger disclosed in Bredeweg et al. discloses a "hook socket for ganging hangers." As with Blanchard et al., the "hook socket" of the hanger disclosed in Bredeweg et al. extends downwardly from hanger body and does not provide any nesting functionality.

U.S. Pat. No. 5,074,445 to Chen discloses a garment hanger with a "ganging hook" extending from the hanger body. The position of the "ganging hook" of Chen impedes nesting of hangers.

Similarly, U.S. Pat. No. 5,803,321 to Willinger et al. discloses a hanger having "ganging element" extending downwardly from the hanger body. As with the previously cited prior art, the "ganging element" of the hanger disclosed in Willinger et al. does not promote nesting of hangers. Like hangers may also be found in U.S. Pat. No. 6,070,772 to Bond; U.S. Pat. No. 6,105,834 to Cohen; U.S. Pat. No. 6,308,872 to Duerr et al.; and U.S. Pat. No. 6,467,658 to Olk et al.

None of the foregoing prior art discloses hangers with hanger supporting means for supporting additional hangers therefrom configured in such a manner so as to allow for nesting of hangers. It is therefore desirable to have a hanger which not only includes hanger supporting means for supporting additional hangers therefrom, but further readily provides for nesting of hangers.

SUMMARY OF THE INVENTION

The subject invention is directed to a new and useful hanger having a hanger supporting means in the form of a cascade hook for supporting additional hangers therefrom, wherein the cascade hook facilitate the nesting of one hanger with another similar hanger.

One embodiment of the present invention includes a garment hanger comprising: a hanger frame comprising a hanger body, the hanger body having a front surface and a rear surface, a top and a bottom; a hook member extending from the top of the hanger body, the body having a hole formed therethrough, the hole having a front aperture formed in the front surface and a rear aperture formed in the rear surface; the body having a cascade hook member extending from the front surface and disposed in front of the front aperture. In these embodiments, the hole is adapted to receive through the rear aperture a cascade hook member from a first identical garment hanger and the cascade hook member is adapted to be inserted into a rear aperture of a hole in a second identical garment hanger.

In certain embodiments, the cascade hook member has an inclined portion having a first end disposed at the bottom of the hole and a second end disposed opposite from the first end, and a second portion extending upwardly from the second end of the inclined portion.

In any of the foregoing embodiments, the cascade hook member may comprise a rear surface substantially facing the front surface of the body; a front surface substantially facing away from the front surface of the body. A projection of the cascade hook member onto a plane containing the front surface of the body may be shaped substantially the same as the front aperture, and the projection may have an area less than the area of the front aperture. The rear aperture may have an area greater than the area of the of the front aperture. There may also be a concavity formed in the rear surface of the cascade hook member.

Furthermore, in any of the foregoing embodiments, the cascade hook member may be adapted to be inserted through the hole of the second identical garment hanger and extend out of a front aperture of the hole of the second identical garment hanger. Upon being inserted through the hole of the second identical garment hanger, the front surface of the cascade hook member may abut a portion of a rear surface of a cascade hanger member of the second identical garment hanger.

A channel may be formed between a portion of the front surface of the cascade hook member and a portion of the rear surface of the cascade hook member of the second identical hanger. Similarly, a cavity may be formed between a portion of the front surface of the cascade hook member and a concavity formed in the rear surface of the cascade hook member of the second identical hanger. Where both a cavity and a channel are formed, the width of the channel may be smaller than the width of the cavity.

These and other aspects of the subject invention will become more readily apparent to those having ordinary skill in the art from the following detailed description of the invention taken in conjunction with the drawings described herein.

BRIEF DESCRIPTION OF THE DRAWINGS

So that those having ordinary skill in the art to which the subject invention pertains will more readily understand how to make and use the subject invention, preferred embodiments thereof will be described in detail herein with reference to the drawings.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
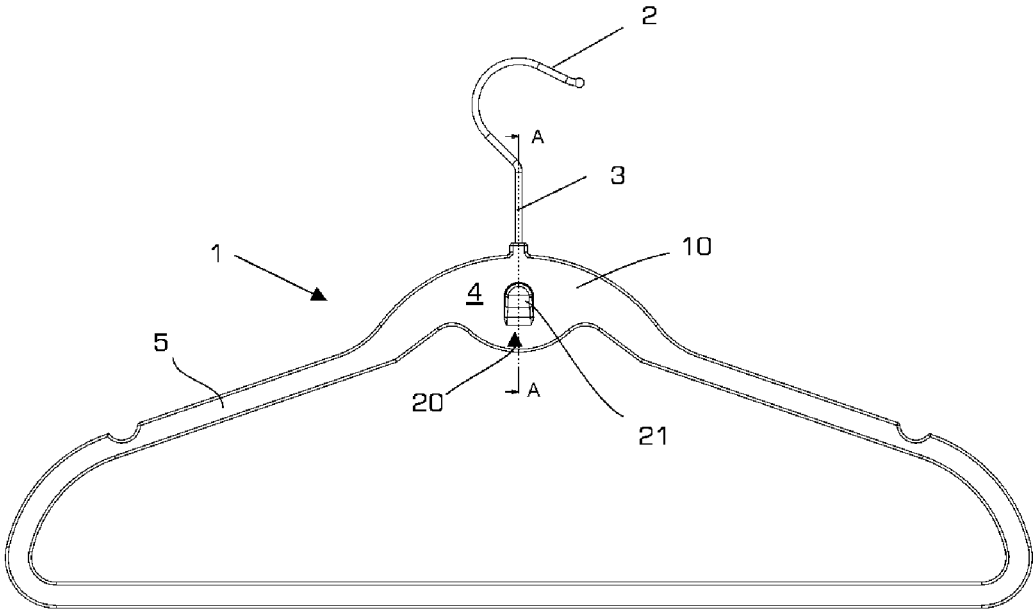
FIG. 1 is a front plan view of a preferred embodiment of the present invention.
Figure 2:
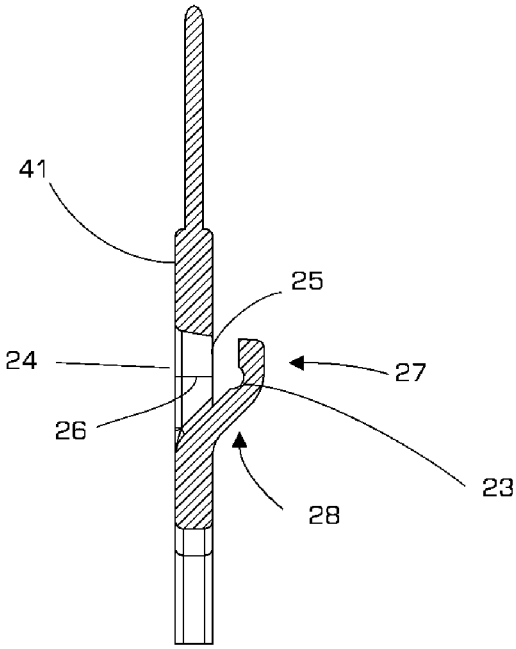
FIG. 2 is a cross-sectional detail of the preferred embodiment depicted in FIG. 1.

Referring to FIGS. 1 and 2, FIG. 1 depicts a front plan view of a preferred embodiment of the present invention. The hanger generally comprises hanger frame 1 and hook member 2 extending upwardly therefrom. Hanger frame comprises body 4 and arms 5 extending from each side of body 4. Hook member 2 is connected to frame 1 via vertical portion 3.

Hanger body 4 includes a generally planar front surface 10 and a rear surface 11 substantially collateral with front surface 10. Cascade hook 20, which may also be called a "finger", extends from front surface 10.

Cascade hook 20, shown in cross section in FIG. 2, has a front surface 21 and a rear surface 22, a vertical portion 27 substantially collateral with front surface 10 of hanger body 4 and an inclined portion 28 extending upwardly and outwardly from front surface 10 of hanger body 4. Inclined portion 28 may form an angle of less than 90 degrees from vertical (i.e., less than 90 degrees from the plane of front surface 10). Cascade hook 20 may omit a vertical portion, and inclined portion 28 may be arranged perpendicularly to front surface 10 without departing from the invention disclosed herein, provided that cascade hook 20 may function to support additional hangers therefrom and allows for nesting of hangers, as will be described in greater detail below.

Cascade hook 20 may include a concavity 23, which may be formed at the intersection of the vertical portion 27 and inclined portion 28. Alternatively, concavity 23 may be omitted.

Figures 7, 7A:
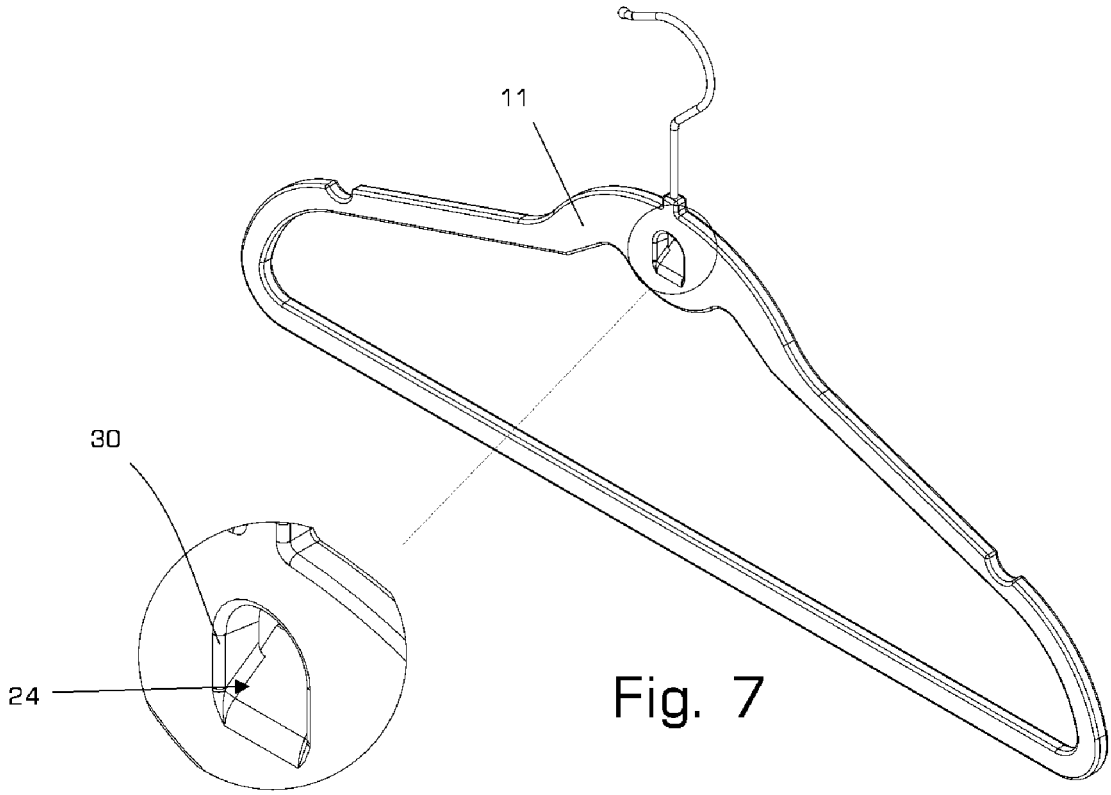
FIG. 7 is a substantially rear orthogonal view of a preferred embodiment of the present invention.

Body 4 includes a hole 26 formed therethrough. Hole 26 has a rear aperture 24 formed in the rear surface 11 and a front aperture 25 formed in front surface 10. Rear aperture 24 may include chamfer 30 (depicted more clearly in FIG. 7). Each of the front and rear apertures have a certain area, that is, each has a certain measure of the planar extent it defines. Cascade hook 20 is shaped substantially the same as front aperture 25, that is, if one projects the shape of cascade hook 20 on the same plane as that occupied by aperture 25 (which is the same as the plane of front surface 10), the projected shape of cascade hook 20 will be substantially the same as the shape of aperture 25. One in the art will readily understand that the projection disclosed herein is not a physical structure, but instead an orthographic projection, that is, a representation of the three dimensional cascade hook 20 on a planar surface corresponding to the plane containing aperture 25.

Front surface 10 may also be curved, in which case apertures 24 and 25 would likewise be curved. In this case, the projection of cascade hook 20 onto a plane would have substantially the same shape as a projection of aperture 25 onto the same plane.

The surface area of front surface 10 which is not occupied by cascade hook 20 may be at least approximately twice that of the surface area occupied by cascade hook 20.

Figure 3:
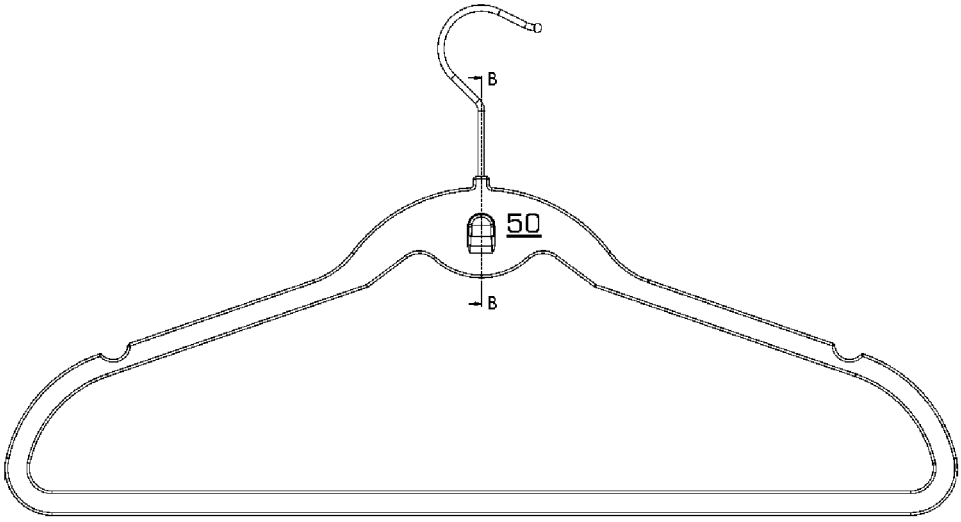
FIG. 3 is a front plan view of two hangers of a preferred embodiment of the present invention shown in a nested configuration.
Figure 4:
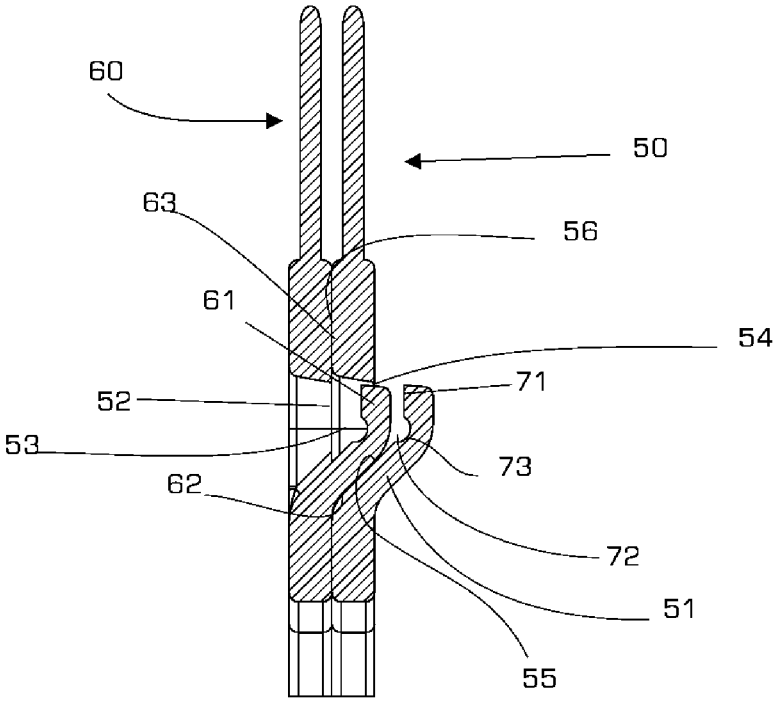
FIG. 4 is a cross-sectional detail of the hangers depicted in FIG. 3.

Referring now to FIGS. 3 and 4, two hangers of a preferred embodiment of the present invention may be seen in a nested configuration. Hanger 50 is placed in front of hanger 60, which is nested with hanger 50. Cascade hook 61 of hanger 60 extends through rear aperture 52 of hanger 50, through hole 53, and partially out front aperture 54 of hanger 50. Front surface 60 of the inclined portion of cascade hook 61 abuts rear surface 55 of cascade hook 51. Front surface 62 of hanger 60 abuts rear surface 56 of hanger 50. Cascade hook 61 may be dimensioned to closely conform to the dimensions of front aperture 54, thereby nesting hanger 60 to hanger 50. Rear aperture 53 may be dimensioned larger than front aperture 54 to more easily receive cascade hook 61 in hole 53.

Figures 5, 5A:
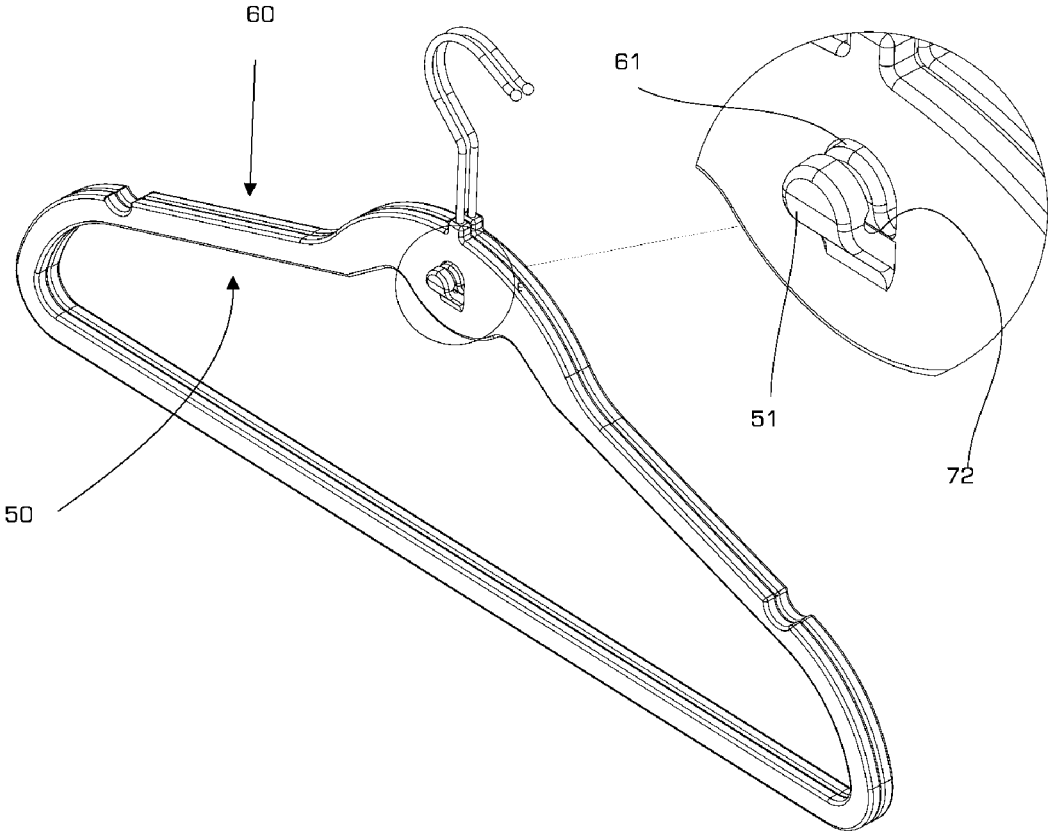
FIG. 5 is an orthogonal view of two hangers of a preferred embodiment of the present invention shown in a nested configuration.
Figures 6, 6A:
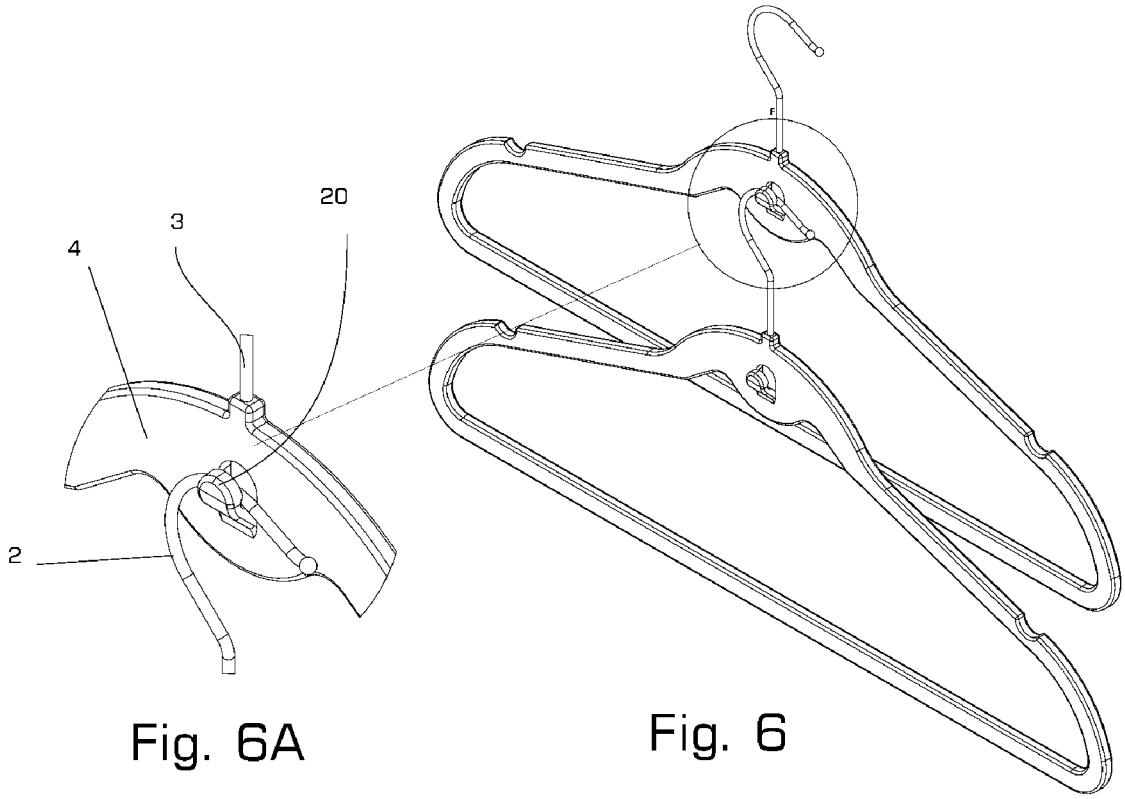
FIG. 6 is an orthogonal view of two hangers of a preferred embodiment of the present invention shown in a cascaded configuration.

When nested as shown in FIGS. 3, 4, and 5, cascade hooks 51 and 61 form channel 71 therebetween, terminating in cavity 72, formed in part by concavity 73 and the front face of cascade hook 61. Concavity 73 may be dimensioned so as to hold a hook member of another hanger therein, while channel 71 may be of smaller dimensions, prohibiting a hook member present in cavity 72 from moving through channel 71, thereby maintaining the hook member in cavity 72. Cavity 72 may be dimensioned to closely approximate the diameter of hook member 2, depicted, for example, in FIGS. 1 and 6.

While particular embodiments of the present invention have been shown and described, it will be apparent to those skilled in the pertinent art that changes and modifications may be made without departing from the invention in its broader aspects.

What is claimed is:

1. A pair of substantially identical nested first and second garment hangers, each said first and second garment hanger comprising:

a hanger frame comprising a hanger body, said hanger body having a front surface and a rear surface, a top and a bottom;

a hook member extending from said top of said hanger body, a cascade hook member having a top surface and a bottom surface, said cascade hook member extending from said front surface;

said body having a hole formed therethrough, said hole having a front aperture formed in said front surface and a rear aperture formed in said rear surface;

wherein said cascade hook member of said first hanger extends through said hole of said second hanger and said front surface of said first hanger abuts against a rear surface of said second hanger, the bottom surface of the cascade hook member of said first hanger abuts the top surface of the cascade hook member of said second hanger, and the top and bottom portion of each said first and second hangers is nested and affixed in a common horizontal plane relative to one another.

2. The pair of first and second garment hangers of claim 1, wherein said cascade hook member comprises:

a rear surface substantially facing said front surface of said body;

a front surface substantially facing away from said front surface of said body;

wherein a projection of said cascade hook member onto a plane containing said front surface of said body is shaped and sized substantially the same as said front aperture, and said projection has an area less than the area of said front aperture and said aperture is sized to allow said cascade hook member to fit within said aperture.

3. The pair of first and second garment hangers of claim 2, wherein said rear aperture has an area greater than the area of said of said front aperture.

4. The pair of first and second garment hangers of claim 3, further comprising a concavity formed in said rear surface of said cascade hook member.

5. The pair of first and second garment hangers of claim 2, wherein said cascade hook member is further adapted to be inserted through said hole of said second identical garment hanger and extend out of a front aperture of said hole of said second identical garment hanger.

6. The pair of first and second garment hangers of claim 5, wherein said rear aperture has an area greater than the area of said of said front aperture.

7. The pair of first and second garment hangers of claim 6, further comprising a concavity formed in said rear surface of said cascade hook member.

8. The pair of first and second garment hangers of claim 5, further comprising a concavity formed in said rear surface of said cascade hook member.

9. The pair of first and second garment hangers of claim 8, wherein said front surface of said cascade hook member, upon being inserted through said hole of said second garment hanger, forms a channel between a portion of said front surface of said cascade hook member and a portion of said rear surface of said cascade hook member of said second hanger.

10. The pair of first and second garment hangers of claim 9, wherein said front surface of said cascade hook member, upon being inserted through said hole of said second garment hanger, forms a cavity between a portion of said front surface of said cascade hook member and a concavity formed in said rear surface of said cascade hook member of said second hanger.

11. The pair of first and second garment hangers of claim 10, wherein the width of said channel is less than the width of said cavity.

12. The pair of first and second garment hangers of claim 8, wherein said front surface of said cascade hook member, upon being inserted through said hole of said second garment hanger, forms a cavity between a portion of said front surface of said cascade hook member and a concavity formed in said rear surface of said cascade hook member of said second hanger.

13. A pair of substantially identical nested first and second garment hangers, each said first and second garment hanger comprising:

a hanger frame comprising a hanger body, said hanger body having a front surface and a rear surface, a top and a bottom;

a hook member extending from said top of said hanger body, said body having a hole formed therethrough, said hole having a top and bottom, a front aperture formed in said front surface and a rear aperture formed in said rear surface;

said body having a cascade hook member extending from said front surface and disposed in front of said front aperture, said cascade hook member comprising:

an inclined portion having a first end disposed at said bottom of said hole and a second end disposed opposite from said first end;

a top surface and a bottom surface;

a second portion extending upwardly from said second end of said inclined portion, wherein said cascade hook of said first hanger extends through said rear aperture in said second garment hanger such that said first and second garment hangers are nested and affixed to one another and the bottom surface of the cascade hook of said first hanger abuts the top surface of the cascade hook of said second hanger and said front surface of said first hanger abuts against said rear surface of said second hanger with the top and bottom portion of each first and second hangers being nested and affixed in a common horizontal plane relative to one another.

14. The pair of first and second garment hangers of claim 13, wherein said cascade hook member further comprises:

a rear surface substantially facing said front surface of said body;

a front surface substantially facing away from said front surface of said body;

wherein a projection of said cascade hook member onto a plane containing said front surface of said body is shaped and sized substantially the same as said front aperture, and said projection has an area less than the area of said front aperture and said aperture is sized to allow said cascade hook member to fit within said aperture.

15. The pair of first and second garment hangers of claim 14, wherein said rear aperture has an area greater than the area of said of said front aperture.

16. The pair of first and second garment hangers of claim 15, further comprising a concavity formed in said rear surface of said cascade hook member.

17. The pair of first and second garment hangers of claim 14, wherein said cascade hook member is further adapted to be inserted through said hole of said second garment hanger and extend out of a front aperture of said hole of said second garment hanger.

18. The pair of first and second garment hangers of claim 17, wherein said rear aperture has an area greater than the area of said of said front aperture.

19. The pair of first and second garment hangers of claim 18, further comprising a concavity formed in said rear surface of said cascade hook member.

20. The pair of first and second garment hangers of claim 17, further comprising a concavity formed in said rear surface of said cascade hook member.

21. The pair of first and second garment hangers of claim 20, wherein said front surface of said cascade hook member, upon being inserted through said hole of said second garment hanger, forms a channel between a portion of said front surface of said cascade hook member and a portion of said rear surface of said cascade hook member of said second hanger.

22. The pair of first and second garment hangers of claim 20, wherein said front surface of said cascade hook member, upon being inserted through said hole of said second garment hanger, forms a cavity between a portion of said front surface of said cascade hook member and a concavity formed in said rear surface of said cascade hook member of said second hanger.

23. The pair of first and second garment hangers of claim 22, wherein said front surface of said cascade hook member, upon being inserted through said hole of said second garment hanger, forms a cavity between a portion of said front surface of said cascade hook member and a concavity formed in said rear surface of said cascade hook member of said second hanger.

24. The pair of first and second garment hangers of claim 23, wherein the width of said channel is less than the width of said cavity.

* * * * *